United States Patent [19]

Boulier

[11] Patent Number: 4,504,310

[45] Date of Patent: Mar. 12, 1985

[54] PROCESS FOR THE PRODUCTION OF HIGH PURITY METALS OR ALLOYS

[75] Inventor: Laurent L. Boulier, Gagny, France

[73] Assignee: C. Delachaux, Gennevilliers, France

[21] Appl. No.: 520,802

[22] Filed: Aug. 5, 1983

[30] Foreign Application Priority Data

Aug. 20, 1982 [FR] France ..... 82 14386

[51] Int. Cl.[3] ..... C21B 15/02

[52] U.S. Cl. ..... 75/27; 75/29; 75/80; 75/84; 420/580; 420/581; 420/583; 420/588

[58] Field of Search ..... 75/27, 84, 29, 80; 420/580, 581, 583, 588

[56] References Cited

U.S. PATENT DOCUMENTS

| | | | |
|---|---|---|---|
| 2,332,415 | 10/1943 | Udy | 75/84 |
| 2,839,379 | 6/1958 | Erasmus | 75/84 |
| 4,106,929 | 8/1978 | Saito et al. | 75/130.5 |
| 4,148,628 | 4/1979 | Fukunishi | 75/10 R |

FOREIGN PATENT DOCUMENTS 1019752 1/1953 France .

*Primary Examiner*—M. J. Andrews
*Attorney, Agent, or Firm*—Ladas & Parry

[57] ABSTRACT

A process for the production of high purity metals or metallic alloys comprises the steps of:

(a) producing a metal or metallic alloy, the non-metallic inclusions of which are, preferably, easily reducible oxides of the base metal;

(b) milling the metal or metallic alloy thus obtained and agglomerating the milled metal or metallic alloy with an agglomerating agent and a reducing agent, so as to form balls; and (c) subjecting the balls to a reducing treatment under regulated conditions of reduced pressure and elevated temperature, at which the reducing agent acts on the non-metallic inclusions while substantial sublimation of the alloying metal or metals is avoided.

The invention is particularly applicable to the production of high purity chromium.

16 Claims, No Drawings

PROCESS FOR THE PRODUCTION OF HIGH PURITY METALS OR ALLOYS

The present invention relates to a process for the production of high purity metals or metallic alloys, particularly of metallic chromium.

Modern industries increasingly demand high purity metals and metallic alloys for the fabrication of mechanical parts.

This is particularly the case of the delicate parts of aeronautical turbo-motors which require super-refractory alloys, called "super-alloys", of very high quality, since the parts involved are those exposed to the greatest stress, both from the thermal and mechanical point of view. Such parts comprise fixed and movable turbine blades, turbine discs, combustion chambers, nozzles etc.

For obtaining satisfactory characteristics, the super-alloys in question have to be produced in an extremely careful and sophisticated manner from starting materials of very high quality, both as regards chemical purity and regularity. This is particularly the case for pure metallic chromium, which is used as an alloying element imparting resistance to high temperature oxidation to the super alloys.

There are, at present, two techniques for producing pure metallic chromium, that is to say the electrolytic technique and the alumino-thermic technique.

The electrolytic technique enables metallic chromium which is of very high chemical purity to be obtained, but which contains too high a content of gases that are very harmful in super-alloys, particularly oxygen, hydrogen and nitrogen.

In order to improve the quality of metallic chromium obtained by electrolysis, a reducing degassing operation is then carried out in vacuo so that the oxygen content of the chromium falls from 2000–5000 ppm for the crude electrolysis product to 300–500 ppm for the metallic chromium obtained after treatment. This treatment makes it also possible appreciably to lower the contents of hydrogen and nitrogen and the contents of certain volatile metals, such as lead, or of certain metalloids, such as sulphur.

Generally, this electrolytic chromium, degassed in vacuo, is preferred for the production of the delicate parts of aeronautical turboshaft engines, because of its high purity and its low oxygen content.

The alumino-thermic technique consists in reducing at very high temperature, that is to say above 2000° C., chemically pure chromium oxide (99.5 to 99.7% of $Cr_2O_3$) with aluminium powder. Even though, by suitable choice of the starting materials used and highly developed and very careful reaction technology, chromium of chemical purity that is generally very satisfactory and, in certain cases, better than by electrolysis, is successfully obtained the process inevitably leads to the presence in the pure metallic chromium obtained after cooling of non-metallic inclusions, alumina and chromium oxide. The resulting oxygen content, which varies in inverse proportion to the content of residual reducing agent in the metallic chromium, in this case the aluminium content is then prohibitive for the most delicate aeronautical uses, which in any case can tolerate only very low residual aluminium contents.

The process of the invention enables various metals, particularly chromium, and various alloys to be produced in high purity.

The process of the invention is based essentially on the initial formation of a metal or metallic alloy, containing preferably easily reducible non-metallic inclusions, oxides of the base metal, which is then milled and agglomerated, before being subjected to a reducing treatment in vacuo.

The formation of the metal or metallic alloy is preferably brought about by a non-stoichiometric alumino-thermic reaction which enables the content of aluminous inclusions that are difficult to reduce to be lowered to a minimum, but the formation can also be brought about by other techniques, for example, by a silicothermic method, by reduction in an electric furnace etc., provided that the characteristics of the non-metallic inclusions make it possible to carry out the later steps of milling and reducing treatment in vacuo.

The invention comprises the steps consisting of:

(a) forming a metal or metallic alloy with non-metallic inclusions which are preferably easily reducible oxides of the base metal;

(b) milling the metal or alloy thus obtained and agglomerating the milled metal or metallic alloy with an agglomerating agent and a reducing agent, so as to form balls; and (c) subjecting the balls to a reducing treatment under conditions of reduced pressure and elevated temperature, at which the reducing agent acts on the reducible non-metallic inclusions but substantial sublimation of the metal or metals is avoided.

As has been indicated in the foregoing, the metals or metallic alloys, which can be obtained in high purity, by the process of the invention, are those capable of forming reducible non-metallic inclusions, which can be practically removed by the milling and vacuum reduction steps, for example, the oxides of the base metal.

Amongst the metals that can be produced by the process of the invention, chromium, titanium, vanadium, molybdenum, manganese, niobium and tungsten may be particularly mentioned. Similarly, the alloys, envisaged within the scope of the invention, are alloys comprising at least one of the proceding metals and/or boron, these alloys also comprising ferro-alloys generally.

In accordance with a preferred embodiment of the invention, step (a) comprises an alumino-thermic reaction between at least one metal oxide and comminuted aluminium, the reaction being kept out of equilibrium by a deficiency of aluminium compared with the usual quantity, whereby the presence of inclusions of alumina, $Al_2O_3$, is reduced to a minimum.

This aluminium deficiency, which may, for example, represent from 0.5 to 8%, preferably from 2 to 5%, by weight of the usual quantity, is indispensable for reducing to a minimum the alumina inclusions which are most difficult to reduce.

The alumino-thermic reaction which is kept out of equilibrium by deliberately using a deficiency of aluminium, compared with the usual quantity, is completely at variance with the customary alumino-thermic processes, in which quantities of aluminium closer to the stoichiometric amounts required for the reaction are always used, so as to obtain maximum yield. In the usual process a product is obtained in which the non-metallic inclusions largely consist of alumina that is difficult to reduce.

As has been indicated in the foregoing, the preferred metal for carrying out the process of the invention is chromium.

The metallic chromium is prepared advantageously by an out of equilibrium alumino-thermic reaction, as described above, between chromium oxide, optionally an additive such as potassium bichromate, and comminuted aluminium. The use of additives of this kind in alumino-thermic reactions is well known for supplying additional oxygen and for heating up the alumino-thermic reaction.

The milling step (b) is advantageously carried out by means of an impact mill, for example, a hammer mill.

In a preferred embodiment of the invention, the milling of the metal or of the metallic alloy is a so-called "purifying" milling operation which enables a certain flow of scavenging air to be introduced, for partly entraining the non-metallic inclusions liberated during milling. This purification, which accompanies the milling, is not essential, but is clearly preferred, since it enables a first physical separation of the non-metallic inclusions to take place before the reducing treatment of step (c). It should be noted, however, that the non-metallic inclusions preferentially liberated during the milling, seem to be the inclusions of the oxide of the base metal, for example, the inclusions of $Cr_2O_3$ in the case of the production of metallic chromium.

The purifying milling operation is supplemented advantageously by the removal, by sieving or any other selective separation, of the finest particles of the milled product, in which virtually the whole of the non-metallic inclusions, liberated by the milling, are concentrated.

The milled product thus obtained, the non-metallic inclusions of which have been partly removed, is then agglomerated with an agglomerating agent and a reducing agent, so as to form balls. The agglomerating agent advantageously consists of an organic compound or a mixture of organic compounds, capable of forming during the heating of step (c), a carbon lattice which complements the reducing action of the reducing agent. The agglomerating agent may, for example, consist of a mixture of bakelite and furfuraldehyde and the reducing agent consists advantageously of carbon black.

In step (b), the balls are shaped in a conventional compacting press and then stoved at a regulated temperature, for example, between 200° and 230° C., so as to avoid any oxidation of the metal or metals of which the balls consist, while obtaining satisfactory cohesion.

In accordance with a preferred embodiment of the invention, the reducing treatment is carried out in a vacuum furnace and may be supplemented by scavenging by means of a non-oxidising or reducing gas that is not soluble in the metal or alloy.

The metallic product obtained after the reducing treatment in vacuo is cooled in a neutral atmosphere and can then be used in the fabrication of metal parts.

Other characteristics and advantages of the invention will become clear from the following detailed description, which relates to the production of high purity metallic chromium. This description represents only a non-limiting example and in no way limits the scope of the invention.

Step a

Chromium oxide ($Cr_2O_3$), potassium bichromate ($K_2Cr_2O_7$) and comminuted aluminium are introduced into an alumino-thermic crucible, lined with refractory material. The chromium oxide and the potassium bichromate are advantageously commercial products, having a particle size distribution of between 0 and 15 μm, while the comminuted aluminium is composed of grains smaller than 1 μm.

The chromium oxide and the potassium bichromate are present in the normal proportions for a conventional alumino-thermic reaction, whereas the aluminium is present in a deficiency, compared with the proportion used in the conventional alumino-thermic reaction. As has been indicated above, this aluminium deficiency may represent from 0.5 to 8%, preferably from 2 to 5%, by weight of the usual quantity.

The three components are carefully mixed and then the reaction is initiated in the crucible in a suitable manner. The temperature of the reaction rapidly reaches a value of about 2200° C. and, at the end of the reaction, the metal at the bottom of the crucible and the supernatant slag are collected.

Analysis of the metallic chromium obtained shows that, through the deliberate act of using a deficiency of aluminium which resulted in not attaining the optimum extractive yield, the residual aluminium content in the metallic chromium falls to very low levels, below 0.01% (100 ppm). This analysis also shows that the content of non-metallic inclusions rises very rapidly, so as to reach high levels of 0.40 to 0.80% and even more, but that virtually the whole of these non-metallic inclusions consists of unreduced chromium oxide ($Cr_2O_3$).

This procedure stands in marked contrast to the conventional method, in which the maximum yield is always aimed at for economic reasons, by using higher quantities of aluminium, but still remaining compatible with the maximum admissible residual aluminium content. Thus, if a conventional alumino-thermic reaction is carried out between chromium oxide and aluminium in the usual quality, an inclusion content of 1500 to 2500 ppm, at least a major part of which is in the form of alumina, $Al_2O_3$, is obtained for a residual aluminium content in the metallic chromium of 0.1% maximum, this being the maximum usually allowed content of aeronautical applications.

Without wishing to limit the invention to a particular theory, an attempt may nevertheless be made to explain the mechanism of the observed phenomenon. In contrast to a formerly accepted opinion, the non-metallic inclusions of alumina, $Al_2O_3$, present in the normal solidified pure metallic chromium, do not consist of reaction slag, (chromium corundum, that is to say aluminous slag from the reduction with aluminium), which is badly decanted and is trapped during the passage of the metal from the liquid state to the solid state. On the contrary, the inclusions are secondary alumina, formed either at the moment of solidification or even in the metal in the solid state, at a temperature slightly below the solidus temperature, that is to say while the metal is still at a very high temperature at which the phenomena of diffusion and the reactivity of the components are very strong. This secondary alumina would, in fact, have resulted from the reaction between the chromium oxide or the oxygen dissolved in the chromium metal, and the excess residual aluminium, which is also present in the chromium metal, the equilibrium conditions having been shifted with the lowering of the temperature or the state being by nature out of equilibrium.

Thus, in the conventional alumino-thermic reactions, in which the quantities of aluminium are larger and approach the stoichiometric amount for the reaction, residual aluminium is present in sufficiently large quantity to be able to reduce the whole of the chromium oxide or of the dissolved oxygen and there may even remain an unused excess in the chromium. The non-metallic inclusions, which remain confined in the solid metal, are then substantially wholly formed of alumina $Al_2O_3$.

If, however, in accordance with the process of the invention, a deficiency of aluminium is used, the residual aluminium present is insufficient to reduce the whole of the chromium oxide or of the dissolved oxygen. All or almost all the residual aluminium present is oxidised by the oxygen present, (phase equilibrium on slow cooling), and the excess chromium oxide or dissolved oxygen, which is not reduced, precipitates in the form of non-metallic inclusions, $Cr_2O_3$, there being fewer aluminous inclusions, $Al_2O_3$, and more $Cr_2O_3$ inclusions, the more marked the aluminium deficiency with which the reduction has been carried out, (reaction kept out of equilibrium by deficiency).

The alumino-thermic reaction of step (a) clearly gives a slightly lower yield than in the conventional alumino-thermic processes.

With the process of the invention, nevertheless, the elementary chromium is in the reduced state and the final product obtained is a high purity metallic chromium identical with the normal good quality alumino-thermic metallic chromium, except that it contains a very high oxygen content (2000 to 3000 ppm or more), but almost exclusively in the form of non-metallic inclusions, $Cr_2O_3$, (0.40 to 0.80% or more), with the presence of very slight aluminous inclusions, $Al_2O_3$, (100 to 400 ppm, corresponding to 50 to 200 ppm of oxygen bound to aluminium.

As a result, a metallic chromium is obtained with non-metallic inclusions, mainly consisting of easily removable inclusions of $Cr_2O_3$ and, secondarily, of inclusions of alumina, which are more difficult to remove but are present in small quantity.

Step b

The metallic chromium, from step (a) is milled in an impact mill, which consists advantageously of a hammer-type high energy mill (movable hammers against fixed hammers), until a fine powder, passing completely through a sieve of 200 $\mu$m mesh aperture, is obtained. The high energy of the impact of the mill causes the grains to split so that the non-metallic inclusions, $Al_2O_3$ and $Cr_2O_3$, contained in the metal are set free, at least to a large extent, the $Cr_2O_3$ inclusions being apparently set free preferentially.

In the present example, the milling operation is a purifying milling operation, in which an air current, that is to say a flow of scavenging air is introduced. This air current can be directly produced by the mill itself or, introduced indirectly, by an attached device, such as a blower. This scavenging air enables the product that is being milled to be ventilated which, on the one hand, avoids the heating of the product and thus, possibly its oxidation and its nitridation by the ambient air and, on the other hand, the finest and the lightest fractions, that is to say, the liberated non-metallic inclusions, the density of which is less, are entrained in the scavenging air current.

The air flow can be regulated deliberately, so as to strengthen the purifying effect, if it is desired. Similarly, this purifying effect may be supplemented by the removal, by sieving or any other selective separation, of the finest particles of the milled product, in which virtually the whole of the non-metallic inclusions liberated by milling, are concentrated.

The purified chromium powder thus obtained is then intimately mixed with a reducing agent and an agglomerating agent. The latter consists advantageously of a mixture of bakelite and furfuraldehyde. The purpose of the furfuraldehyde is to promote cold agglomeration, the bakelite dissolved in the furfuraldehyde, forming a cold adhesive, as well as to promote the ultimate hot polymerisation of the bakelite. It is clearly possible to use other thermosetting agglomerating agents and other solvents.

As regards the reducing agent, this consists advantageously of carbon black, to supplement the carbon formed from the bakelite. The respective quantities of these products can be varied but they are adapted overall, in slight excess, to the residual oxygen content of the milled product. By way of example, the mixture of reducing agent and agglomerating agent may consist of 0.1% of bakelite, 0.3% of furfuraldehyde and 0.05 to 0.2% of carbon black, these percentages being related to the weight of the milled product.

The mixture obtained is converted into balls or pellets by means of a conventional compacting press, such as a ball-forming press with touching wheels or a pelleting press. After agglomeration, the mixture is stoved at a temperature (about 200° to 230° C.), sufficient to remove the volatile furfuraldehyde and polymerise the bakelite which forms the binder and imparts structure to the balls or pellets.

It should be pointed out, however, that the stoving temperature has to be limited to the minimum required, so as to avoid any oxidation of the product.

Step c

The balls or pellets obtained in the preceding step are then subjected to a reducing treatment at 1100°–1400° C., under a high vacuum of the order of $10^{-4}$ mm of mercury.

At the beginning of the vacuum heating cycle, at a temperature towards 600° C., the bakelite decomposes leaving a carbon lattice, which is added to the carbon black introduced as reducing agent into the mixture. Once it has reached the treatment temperature, this carbon reacts with the oxygen of the $Cr_2O_3$, which remains in the product, but hardly reacts at all with the oxygen of the alumina, $Al_2O_3$, since to reduce the alumina, it would be necessary to work at a higher temperature and reach a higher vacuum.

It should be noted, in this connection, that, at a temperature of 1200° to 1300° under a vacuum of $10^{-4}$ mm of mercury chromium sublimes and a not negligible part will be vaporised. This explains why it is economically not feasible to take the reduction of the residual alumina further and justifies the prodcedure "out of equilibrium" of step (a), so as to limit the residual alumina to its strictest minimum.

The vacuum in the treatment furnace is taken back to $10^{-1}$ mm of mercury by controlled scavenging with a non-oxidising or reducing gas, such as hydrogen, the special feature of which is that it is virtually insoluble in the solid chromium.

Owing to the relatively low vacuum and the relatively low temperature, which is determined by the sublimation of the chromium, the treatment may take several hours for attaining a substantially complete reaction.

After conclusion of the reaction and after cooling in a neutral atmosphere, a product is obtained, containing, at most, 300 to 400 ppm of total oxygen in the form of 200 to 300 ppm of alumina, containing about 100 to 150 ppm of oxygen, and about 500 ppm, at most, of unreduced chromium oxide, containing about 150 ppm of oxygen. Consequently, this is a high purity chromium, which enables super-alloys to be produced for use, in particular, in the fabrication of the delicate parts of aeronautical turbo-motors.

It has to be noted that the use of a conventional starting product without imbalance at the level of step (a) would inevitably lead, to the extent that it is desired to lower the oxygen content to the required level of about 300 ppm, to a treatment enabling the $Al_2O_3$ to be reduced by the carbon, which, apart from the above-mentioned shortcomings, would cause a rise in the residual aluminium content of the finished product to levels that are not acceptable to the users who form the super-alloys.

Clearly, the invention is not limited to the preferred embodiment described above and other variants in the procedure can be visualised, without departing from the scope of the invention. Thus step (a) may be carried out otherwise than by an alumino-thermic method, for example, by a silicothermic method or by reduction in an electric furnace, so as to obtain a metal or alloy comprising non-metallic inclusions, being oxides of the base metal.

As regards the silicothermic method, it is possible to mention, by way of non-limiting examples, the production of ferrochrome or of chromium metal by reduction with silicon metal or silicochrome, and the production of ferrotungsten or ferromolybdenum by reduction with a high content ferrosilicon or silicon metal. As regards reduction in the electric furnace, it is possible to mention, by way of non-limiting example, the production of ferrovanadium in the electric furnace, followed by an alumino-thermic process.

I claim:

1. A process for the production of a high purity metal or metallic alloy, comprising (a) forming a base metal or metallic alloy by an alumino-thermic reaction between at least one metal oxide and comminuted aluminum, the reaction being kept out of equilibrium by a deficiency of aluminum relative to stoichiometic quantity, whereby said base metal or metallic alloy contains reducible non-metallic inclusions comprising principally inclusions of the oxide of the base metal, with a minor amount of inclusions of alumina;

(b) milling the base metal or metallic alloy thus obtained;

(c) agglomerating the milled metal or metallic alloy with an agglomerating agent and a reducing agent, so as to form compacted agglomerates; and (d) subjecting the compacted agglomerates to a reducing treatment under regulated conditions of reduced pressure and elevated temperature at which the reducing agent acts on the non-metallic inclusions but substantial sublimation of the metal or metallic alloy is avoided.

2. A process according to claim 1, wherein the metal or metallic alloy is selected from the group consisting of chromium, titanium, vanadium, molybdenum, manganese, nobium, tungsten and alloys of at least one of the preceding metals.

3. A process according to claim 1, wherein the metallic product obtained after the reducing treatment is cooled in a neutral atmosphere.

4. A process according to claim 1 wherein the aluminium deficiency represents from 0.5 to 8% by weight of the stoichiometric quantity.

5. A process according to claim 1, for the preparation of high purity metallic chromium, wherein the alumino-thermic reaction is carried out between chromium oxide and comminuted aluminium.

6. A process according to claim 5, wherein the alumino-thermic reaction is carried out with potassium bichromate as supplemental reagent.

7. A process according to claim 1, wherein the milling of the metal or of the metallic alloy of step (b) is carried out in an impact mill.

8. A process according to claim 7, wherein the impact mill is a hammer mill.

9. A process according to claim 1, wherein step (b) comprises a purifying milling operation producing a flow of scavenging air for at least partly entraining non-metallic inclusions liberated during milling.

10. A process according to claim 9, wherein step (b) further comprises an air scavenging for separation of non-metallic inclusions liberated by said milling.

11. A process according to claim 1, wherein the agglomerating agent used in step (c) is a bakelite/furfuraldehyde mixture.

12. A process according to claim 1, wherein the reducing agent used in step (c) is carbon black.

13. A process according to claim 1, wherein in step (c), the compacted agglomerates are shaped in a compacting press and then stoved at a regulated temperature so as to avoid any oxidation of the metal or metals of which the compacted agglomerates consist, while obtaining satisfactory cohesion.

14. A process according to claim 13, wherein the stoving temperature lies between 200° C. and 230° C.

15. A process according to claim 1, wherein in step (d) the reducing treatment is carried out in a vacuum furnace which, is scavenged by means of a non-oxidising or reducing gas that is not soluble in the metal or alloy.

16. A process according to claim 15, for the production of high purity metallic chromium, wherein chromium balls containing inclusions of chromium oxide and alumina are subjected to a reducing treatment at a temperature of 1100° C. to 1400° C. and at a high vacuum and that, during the treatment, the pressure is taken back to a lower vacuum level by scavenging with a non-oxidising or reducing gas.

* * * * *

UNITED STATES PATENT AND TRADEMARK OFFICE

CERTIFICATE OF CORRECTION

PATENT NO. : 4,504,310

DATED : March 12, 1985

INVENTOR(S) : Laurent L. BOULIER

It is certified that error appears in the above-identified patent and that said Letters Patent is hereby corrected as shown below:

Column 3, line 68, "1 μm" should read -- 1 mm --.

Signed and Sealed this

*Fifteenth* Day of *October 1985*

[SEAL]

*Attest:*

DONALD J. QUIGG

*Attesting Officer*

*Commissioner of Patents and Trademarks—Designate*

UNITED STATES PATENT AND TRADEMARK OFFICE

CERTIFICATE OF CORRECTION

PATENT NO. : B1 4,504,310
DATED : March 15, 1994
INVENTOR(S) : Laurent L. Boulier It is certified that error appears in the above-indentified patent and that said Letters Patent is hereby corrected as shown below:

Title page, left column, after "Reexamination Request", "No. 90/002,180" should be -- No. 90/002,810 -- .

Signed and Sealed this

Fifteenth Day of November, 1994

*Attest:*

*Attesting Officer*

BRUCE LEHMAN

*Commissioner of Patents and Trademarks*

US004504310B1

REEXAMINATION CERTIFICATE (2242nd)

United States Patent [19]

Boulier

[11] B1 4,504,310

[45] Certificate Issued Mar. 15, 1994

[54] PROCESS FOR THE PRODUCTION OF HIGH PURITY METALS OR ALLOYS

[75] Inventor: Laurent ⁵. Boulier, Gagny, France

[73] Assignee: C. Delachaux, Gennevilliers, France

Reexamination Request:
No. 90/002,180, Aug. 7, 1992

Reexamination Certificate for:

| | |
|---|---|
| Patent No.: | **4,504,310** |
| Issued: | **Mar. 12, 1985** |
| Appl. No.: | **520,802** |
| Filed: | **Aug. 5, 1983** |

Certificate of Correction issued Oct. 15, 1985.

[30] Foreign Application Priority Data

Aug. 20, 1982 [FR] France ..... 82 14386

[51] Int. Cl.[5] ..... C21B 15/02

[52] U.S. Cl. ..... 75/623; 75/959; 420/580; 420/581; 420/583; 420/588

[58] Field of Search ..... 75/623, 959; 420/580, 420/581, 583, 588

[56] References Cited

U.S. PATENT DOCUMENTS 4,150,975 7/1978 Miyake et al. ..... 75/623

FOREIGN PATENT DOCUMENTS 1019752 1/1953 France .
54-4807 1/1979 Japan .

OTHER PUBLICATIONS

Translation of Ullmanns Encyklopadie der technischen Chemie; Verlang Chemie, Weinheim/Bergstr, 1975, p. 591, T 1.2.1.

Russian Metallurgy and Mining 1963 pp. 20–25.

*Primary Examiner*—Melvyn J. Andrews

[57] ABSTRACT

A process for the production of high purity metals or metallic alloys comprises the steps of:

(a) producing a metal or metallic alloy, the non-metallic inclusions of which are, preferably, easily reducible oxides of the base metal;

(b) milling the metal or metallic alloy thus obtained and agglomerating the milling metal or metallic alloy with an agglomerating agent and a reducing agent, so as to form balls; and (c) subjecting the balls to a reducing treatment under regulated conditions of reduced pressure and elevated temperature, at which the reducing agent acts on the non-metallic inclusions while substantial sublimation of the alloying metal or metals is avoided.

The invention is particularly applicable to the production of high purity chromium.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERINED THAT:

The patentability of claims 1, 2, 3 and 5–16 is confirmed.

Claim 4 is cancelled.

* * * * *